US005590705A

United States Patent [19]

Chevalier et al.

[11] Patent Number: 5,590,705

[45] Date of Patent: Jan. 7, 1997

[54] DEVICE FOR GENERATING A HOT AIR FLOW

[75] Inventors: Alain Chevalier, Asnieres/Bourges; Marc Bouchez, Saint-Doulchard, both of France

[73] Assignee: Societe Anonyme dite: Aerospatiale Societe Nationale Industrielle, Paris, France

[21] Appl. No.: 494,704

[22] Filed: Jun. 26, 1995

[30] Foreign Application Priority Data

Jul. 12, 1994 [FR] France ..... 94 08618

[51] Int. Cl.[6] ..... F23L 15/02

[52] U.S. Cl. ..... 165/9; 165/8; 165/6; 165/10

[58] Field of Search ..... 165/8, 6, 4, 10, 165/9, 909

[56] References Cited

U.S. PATENT DOCUMENTS

| | | | |
|---|---|---|---|
| 1,940,371 | 12/1933 | Royster | 165/4 |
| 2,761,654 | 9/1956 | Valvo | 165/9 |
| 3,891,028 | 6/1975 | Penny | 165/6 |
| 4,129,176 | 12/1978 | Heyn et al. | 165/8 X |
| 4,280,416 | 7/1981 | Edgerton | 165/4 X |
| 4,286,141 | 8/1981 | MacCracken | 165/10 X |
| 4,542,782 | 9/1985 | Berner | 165/8 X |
| 4,708,639 | 11/1987 | Momose | 165/9 X |
| 4,793,974 | 12/1988 | Hebrank | 165/4 X |
| 4,909,307 | 3/1990 | Besik | 165/4 |
| 4,960,166 | 10/1990 | Hirt | 165/8 X |
| 5,137,078 | 8/1992 | Borowy | 165/9 |

FOREIGN PATENT DOCUMENTS

| | | | |
|---|---|---|---|
| 0343938A1 | 11/1989 | European Pat. Off. . | |
| 2707781 | 9/1977 | Germany | 165/6 |
| 1293146 | 10/1972 | United Kingdom . | |
| 2084311 | 4/1982 | United Kingdom | 165/8 |

*Primary Examiner*—John Rivell
*Assistant Examiner*—Christopher Atkinson
*Attorney, Agent, or Firm*—Watson Cole Stevens Davis, P.L.L.C.

[57] ABSTRACT

The present invention relates to a device generating a hot air flow, including an air source generating an air flow at its outlet (17), a heating system (13) generating heat energy and heat-exchange elements (27) capable of storing heat energy generated by said heating system (13) and of yielding this heat energy to said air flow.

According to the invention, said heating system (13) and said air source are mounted fixed, and said heat-exchange elements (27) are arranged on a mobile support (3) capable of continuously renewing the heat-exchange elements (27) arranged in said air flow and previously heated by said heating system (13).

9 Claims, 2 Drawing Sheets

DEVICE FOR GENERATING A HOT AIR FLOW

The present invention relates to a device for generating a hot air flow.

Although the present invention can be used in numerous installations requiring a hot air flow, such as, for example, installations for testing the stability of materials or for aerodynamic tests or for validating wall cooling systems, it will be described more particularly hereafter in the context of a test rig for developing ramjets.

It is known that, for such development, in particular of ramjets intended to operate at hypersonic speeds, it is necessary to feed the ramjets mounted on the test rig with air which is both at high temperature and as pure as possible. In addition, such an air feed must be carried out continuously over a period of time which is generally very long, so as to simulate a flight or to verify the thermal stability of the ramjet in thermal steady state.

In order to generate hot air, static heaters are known which include a heating device, for example a gas burner or an electrical device, and intended to heat a material having a high heat capacity, such as, for example, alumina balls or metallic tubes. When said material is heated, pure air is passed into the heater, which makes it possible to obtain air which is both at elevated temperature and is furthermore pure, since passage through said heater does not change the composition of the air used.

However, since the heat capacity of the material used is obviously limited, it is not possible in this way to generate hot air over a very long period of time, and one of the essential characteristics for the operation of test rigs of the type previously described, namely continuous air feed, is therefore not satisfied.

Furthermore, active heaters are known which make it possible to heat air continuously by combustion using, for example, hydrogen or kerosene, as well as the oxygen in the air to be heated, the consumed oxygen being replenished after heating. The hot air thus obtained is composed of air and of products generated during this combustion. This air is therefore not pure, which raises drawbacks for combustion studies, in particular in cases where kinetics play an important role, since it is then very difficult to reproduce on the ground functioning conditions similar to those existing in flight.

The object of the present invention is to overcome these drawbacks. It relates to a device for generating hot air which can provide uncontaminated air at high temperature, and do this without time limitation.

To this end, according to the invention the device generating a hot air flow, including an air source generating an air flow at its outlet, a heating system generating heat energy at its outlet and heat-exchange elements capable of storing heat energy generated by said heating system and of yielding this heat energy to said air flow, is noteworthy in that said heating system and said air source are respectively mounted fixed so that said air flow generated by said air source cannot be subjected to the action of said heating system, and in that said heat-exchange elements are arranged on a mobile support capable of passing said heat-exchange elements from a first position in which they are in front of the outlet of said heating system to a second position in which they are in front of the outlet of said air source, so as continuously to renew the heat-exchange elements arranged in said air flow and previously heated by said heating system.

Thus, since the heat-exchange elements which transport the heat stored in the heating system and are used for heating said air flow are renewed continuously, the hot air flow is generated without interruption and without time limitation, that is to say for as long as is desired.

In addition, since the air flow is not subjected to the action of the heating system, the hot air flow generated is not contaminated by said heating system, which makes it possible to obtain hot air having the same purity as the air generated at the outlet of the air source.

Advantageously, said heating system includes at least one burner fed with a combustible fluid, said burner being mounted so that the gases generated by combustion of said combustible fluid do not mix with said heated air flow.

Furthermore, said burner advantageously uses, for combustion of said combustible fluid, air coming from said air source and not used for generating the hot air flow.

In a preferred embodiment of the invention, said mobile support is rotary, which makes it possible to simplify the device according to the invention.

In addition, preferably, said mobile support has the form of a cylindrical container, at least partially filled with said heat-exchange elements.

Advantageously, said cylindrical container is provided in the upper wall with a first annular opening, concentric with the axis of the cylindrical container and, in the lower wall, with a second annular opening, also concentric with the axis of the cylindrical container, said second opening being provided with a metallic mesh, and the outlet of the heating system and the outlet of the air source being arranged below said second opening, diametrically opposite relative to the axis of the cylindrical container.

Furthermore, the device according to the invention advantageously includes an enclosure which is mounted fixed, said container being mobile in said enclosure and the outlets of said air source and of said heating system being arranged in said enclosure.

In addition, advantageously, said device includes isolation means arranged between the container and the enclosure and intended to prevent circulation of air between said container and said enclosure, which makes it possible to prevent unheated air coming directly from the air source, or possibly contaminated air coming from the heating system from mixing with the hot air flow generated.

In addition, so as to allow adequate removal of the various air flows, said enclosure may be provided in its upper wall:

- with a first opening, arranged in front of said outlet of the air source, to which first opening a nozzle may be connected; and
- with a second opening, in front of said outlet of the heating system, to which second opening an exhaust pipe may be connected.

Thus, the hot air flow generated can be removed via the nozzle then transmitted to an application device, such as, for example, a combustion chamber of a ramjet mounted on a test rig, and the possibly contaminated air flow coming from the heating system can be removed via the exhaust pipe, the two air flows thus being incapable of mixing with each other.

In order to make it possible to control the distribution of the air flow through said nozzle and said exhaust pipe, said exhaust pipe is advantageously provided with a controllable internal valve capable of altering the opening intended for exhaust.

In addition, advantageously, a passage is made between said container and said enclosure, in order to allow circulation air from the outlet of the air source to the heating system.

The figures of the attached drawing will clearly show how the invention may be embodied. In these figures, identical references designate similar elements.

Figure 1:
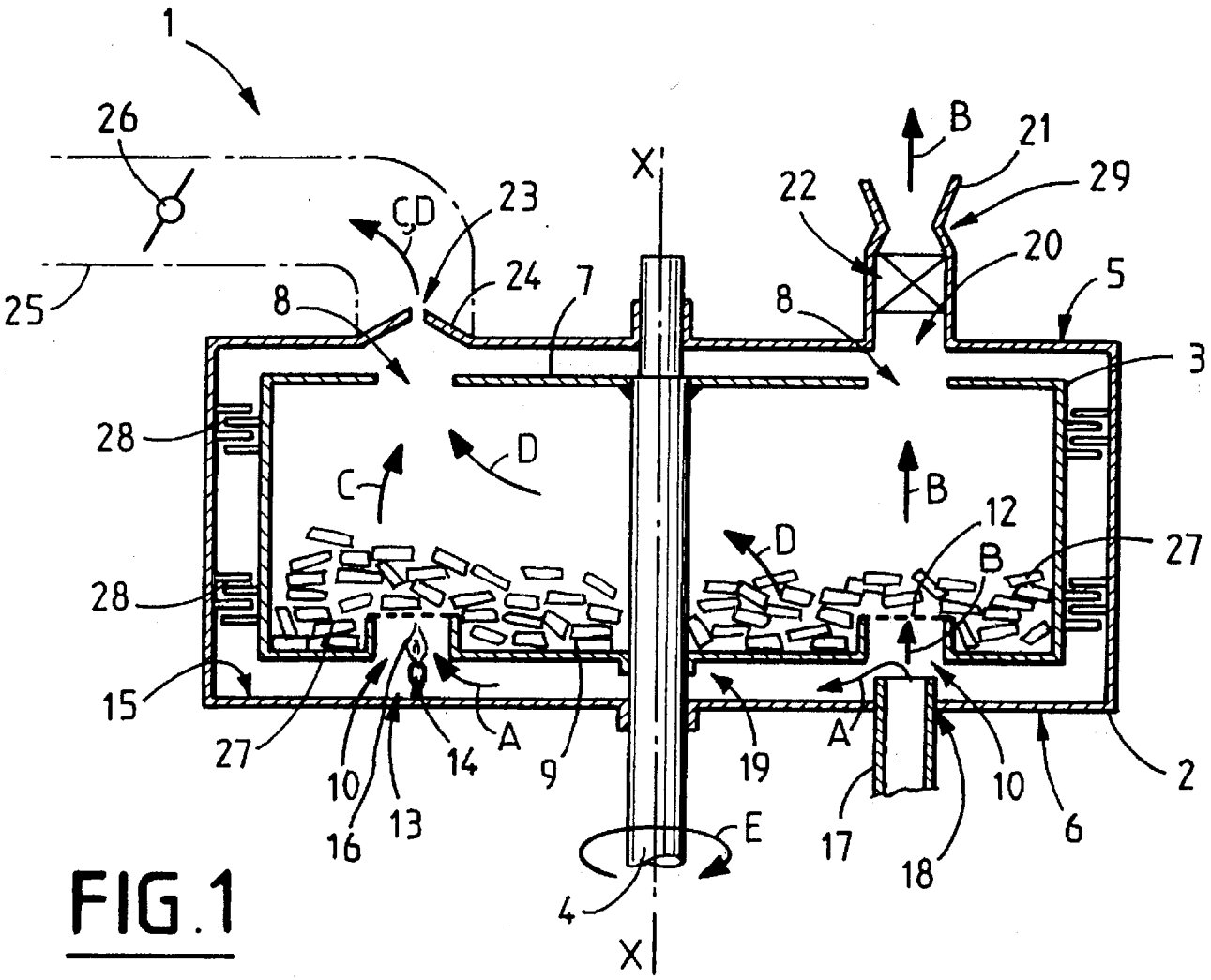
FIG. 1 is a schematic sectional view of a device according to the invention.
Figure 3:
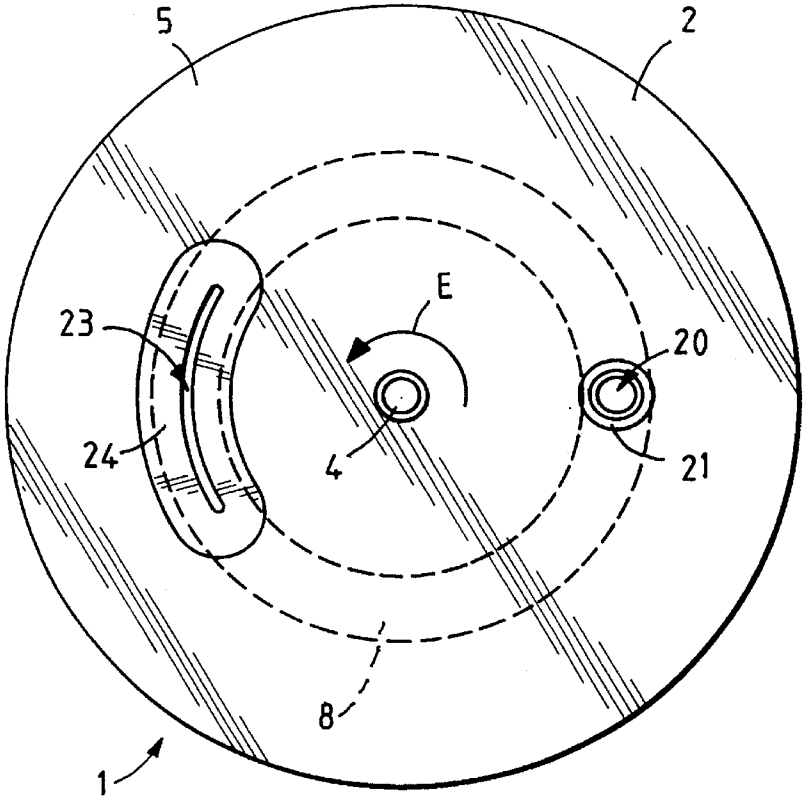
FIG. 3 is a plan view of the device in FIG. 1.
Figure 2:
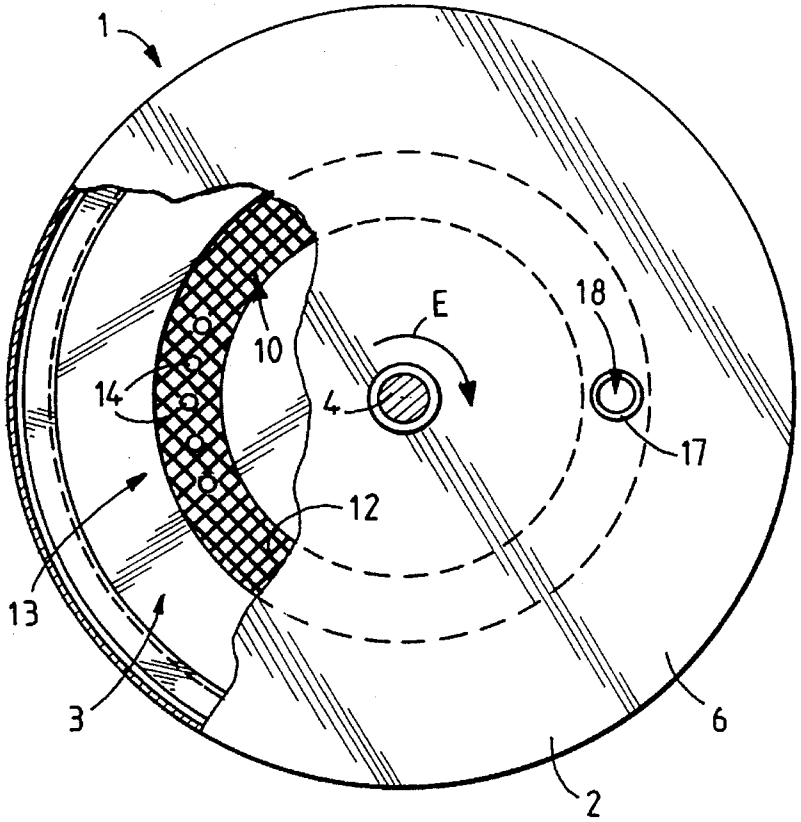
FIG. 2 is a bottom view of the device in FIG. 1, shown with partial cutaway.

The device 1 according to the invention and represented in FIGS. 1 to 3 is intended to generate a hot air flow.

Said device 1 includes an external enclosure 2 mounted fixed and a mobile system produced in the form of a cylindrical container 3 mounted so as to move inside said enclosure 2.

To this end, said cylindrical container 3 is solidly attached to a shaft 4 of axis X—X, mounted so as to rotate in the upper wall 5 and the lower wall of 6 of the enclosure 2 and capable of being driven in rotation, as indicated by an arrow E, by a drive device of known type and not represented. Said container 3 has symmetry of revolution about said axis X—X and is provided in its upper wall 7 with an annular opening 8 concentric with the axis X—X and, in its lower wall 9, with an annular opening 10 which faces the opening 8. Said annular opening 10 is covered with a metallic mesh 12.

It will be noted that, in the context of the present invention, it is possible to produce the entire lower wall 9 in the form of a metallic mesh.

Under said annular opening 10 are arranged:

on the one hand, a heating system 13 generating heat energy at its outlet 16, said heating system 13 including burners 14 fed, in a manner not represented, with a combustible fluid, for example propane, which are fixed on the internal face 15 of the lower wall 6 of the enclosure 2 and distributed in a circular arc at the center of the annular opening 10, as represented in FIG. 2, the burners 14 being indicated schematically by points in this FIG. 2; and on the other hand, opposite said heating system 13 with respect to the axis X—X, the outlet 17 of an air source, not represented and capable of generating two air flows A and B, said outlet 17 passing through an opening 18 made in the lower wall 6 of the enclosure 2 and being solidly attached to said enclosure 2.

One A of said airflows generated by the air source can flow through a passage 19 formed between the lower walls 6 and 9 of said enclosure 2 and of said container 3, in order to feed said burners 14 with air during combustion of the combustible fluid, while the other air flow B is capable of flowing through said container 3, in which it can be heated as will be seen hereafter, in the direction of the annular opening 8 made in the upper wall 7 of said container 3.

The upper wall 5 of the enclosure 2 is, for its part, provided:

on the one hand, with a circular opening 20 made in front of the outlet 17 of the air source, to which opening 20 a nozzle 21, which is provided with a mixer system 22 capable of mixing the air and arranged close to said opening 20, inside said nozzle 21, is connected; and on the other hand, an opening 23 of oblong shape, made in front of the outlet 16 of the heating system 13 and formed in a circular arc in a fashion corresponding to the arrangement of the burners 14, as represented in FIG. 3. An exhaust pipe 25, represented in dots and dashes in FIG. 1 and provided with a controllable internal valve 26 capable of altering the free cross section of said exhaust pipe 25, is connected to said opening 23 via a nozzle element 24.

Furthermore, said container 3 is filled with heat-exchange elements 27, for example balls or tubes, only represented in the bottom of the container 3 in FIG. 1. In addition, for reasons of clarity of the drawing, said heat-exchange elements 27 are represented spread-out in this FIG. 1. Of course, said container 3 may be entirely filled with such heat-exchange elements 27, in very compact fashion, filling being defined as a function of the results to be obtained, as will be seen hereafter. Said heat-exchange elements 27 preferably have a high ratio between their external surface area and their volume and are preferably made of a material having a high specific heat capacity, such as, for example, zirconium dioxide.

In order to generate a hot air flow, the device 1 according to the invention operates as follows.

For this purpose, the following operations are first of all carried out:

the shaft 4 is driven in rotation at low and constant speed and thus rotates said container 3 about the axis X—X;

the air source 17 which generates the two aforementioned air flows A and B is turned on; and the burners 14 of the heating system 13, which are fed with combustible fuel, in a manner not represented, as well as with air by means of the air flow A, are turned on.

Said burners 14 heat the heat-exchange elements 27 located above them. The combustion gases coming from said burners 14 then flow out of the container 3 and the enclosure 2 via the openings 8 and 23, as indicated by arrows C, and are removed via the exhaust pipe 25.

The heat-exchange elements 27 thus store energy above the outlet 16 of the heating system 13. They yield this stored energy, after rotation by one half turn of the container 3, bringing said heat-exchange elements 27 into said air flow B, to said air flow B. Said air flow B is thus heated. In addition, the distribution of heat in this heated air flow B is made homogeneous by passage of said air flow B through said mixer system 22, so as to obtain a homogeneously heated air flow at the outlet of said nozzle 21.

Thus, by virtue of the invention, said hot air flow B has the following characteristics:

its temperature can be determined precisely as a function, in particular, of the intensity of the heating, as well as of the characteristics and of the quantity of the heat-exchange elements 27 used;

it is uncontaminated, the products generated by combustion in the burners 14, and capable of contaminating said air flow B, being removed via the exhaust pipe 25; and the hot air is supplied continuously and homogeneously because of the constant speed of rotation of the container 3, which makes it possible continuously to renew the heat-exchange elements 27 arranged in the air flow B and intended to heat said air flow B.

It will be noted that the air generated by the air source can furthermore flow directly via the opening 23, as indicated by arrows D, the strength of this flow depending in particular on the aerodynamic resistance of the heat-exchange elements 27 placed in the container 3. The distribution of the flow out of the container 3, respectively through the exhaust pipe 25 and the nozzle 21, depends in particular on the size of their respective cross sections. This distribution can thereby be controlled by altering the cross section of the exhaust pipe 25 by means of the controllable valve 26.

Furthermore, isolation is established between the container 3 and the enclosure 2, for example with the aid of labyrinth seals 28 arranged between their vertical walls and a mobile wall, not represented, arranged between their upper walls, which makes it possible to prevent circulation of air between the enclosure 2 and the container 3, so as to prevent on the one hand unheated air coming directly from the air source and, on the other hand, possibly contaminated air coming from the heating system 13 from mixing with said hot air flow.

It will furthermore be noted that the nozzle 21 has, in its central part 29, a decrease in diameter so as to allow removal of air in a forced stream.

Said hot air flow B available at the outlet of said nozzle 21 can be used, for example, for testing the stability of materials or for aerodynamic tests or for validation of wall cooling systems. However, said hot air flow is preferably used for developing ramjets, for which it has suitable characteristics, as previously mentioned, the device 1 according to the invention being associated for this purpose with the test rig used for this development.

We claim:

1. A device for generating a hot air flow, in particular for developing ramjets, comprising:

an air source generating an air flow at its outlet;

a heating system having at least one burner fed with combustible fluid, and an outlet;

a rotatable container having a rotation axis, an upper wall and a lower wall and containing heat-exchange elements capable of storing heat energy generated by said heating system, said container being provided in said upper wall with a first annular opening, concentric with said rotation axis and in said lower wall with a second annular opening, also concentric with said rotation axis and facing said first annular opening; and an enclosure, inside which said container is mounted so as to rotate relative to said enclosure, said enclosure having an upper wall and a lower wall, and said outlet of the air source and said outlet of the heating system being arranged at said lower wall of said enclosure, at diametrically opposite positions relative to said rotation axis of said container, and in front of said second annular opening of said container, said enclosure being provided, in its upper wall, with a first opening, arranged in front of said outlet of the air source, and with a second opening arranged in front of said outlet of the heating system.

2. The device as claimed in claim 1, wherein said burner uses, for combustion of the combustible fluid, air coming from said air source and not used for generating the hot air flow.

3. The device as claimed in claim 1, which includes isolation means arranged between the container and the enclosure and intended to prevent circulation of air between said container and said enclosure.

4. The device as claimed in claim 1, wherein a passage is made between said container and said enclosure, in order to allow circulation air from the outlet of the air source to the heating system.

5. The device as claimed in claim 1, wherein said second annual opening of said container is provided with a metallic mesh.

6. The device as claimed in claim 1, wherein a nozzle is provided at said first opening of the upper wall of said enclosure.

7. The device as claimed in claim 1, wherein said second opening of the upper wall of said enclosure is connected to an exhaust pipe.

8. The device as claimed in claim 7, wherein said exhaust pipe is provided with a controllable internal valve capable of altering the cross section of said exhaust pipe.

9. The device as claimed in claim 1, wherein said container is cylindrical.

* * * * *